US011644230B2

(12) United States Patent
Lee et al.

(10) Patent No.: US 11,644,230 B2
(45) Date of Patent: May 9, 2023

(54) REFRIGERATOR

(71) Applicant: Samsung Electronics Co., Ltd., Suwon-si (KR)

(72) Inventors: In Sub Lee, Suwon-si (KR); Kook Jeong Seo, Suwon-si (KR); Dae Whan Kim, Suwon-si (KR); Hee Yuel Roh, Suwon-si (KR); Jeong-Min Jeon, Suwon-si (KR); Young Don Jeong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 62 days.

(21) Appl. No.: 17/041,149

(22) PCT Filed: Feb. 19, 2019

(86) PCT No.: PCT/KR2019/001970
§ 371 (c)(1),
(2) Date: Sep. 24, 2020

(87) PCT Pub. No.: WO2019/190055
PCT Pub. Date: Oct. 3, 2019

(65) Prior Publication Data

US 2021/0010740 A1 Jan. 14, 2021

(30) Foreign Application Priority Data

Mar. 29, 2018 (KR) ..... 10-2018-0036769

(51) Int. Cl.
*F25D 21/08* (2006.01)

(52) U.S. Cl.
CPC ..... *F25D 21/08* (2013.01)

(58) Field of Classification Search
CPC ..... F25D 2317/063; F25D 2317/0684; F25D 2323/0021; F25D 2323/00283
See application file for complete search history.

(56) References Cited

U.S. PATENT DOCUMENTS 6,341,830 B1 * 1/2002 Chun ..... F25D 23/063 312/406.2
2009/0250132 A1 10/2009 Bivin et al.
(Continued)

FOREIGN PATENT DOCUMENTS

JP 08-42839 A 2/1996
KR 10-2002-0015242 A 2/2002
(Continued)

OTHER PUBLICATIONS

International Search Report and Written Opinion of the International Searching Authority in connection with International Application No. PCT/KR2019/001970 dated May 31, 2019, 8 pages.
(Continued)

*Primary Examiner* — Jianying C Atkisson
*Assistant Examiner* — Meraj A Shaikh

(57) ABSTRACT

Provide is a refrigerator provided with a defrosting device capable of enhancing the defrosting efficiency. The refrigerator includes main body, storage compartment provided inside the main body, an evaporator provided in the storage compartment and configured to generate cold air, a first flow path allowing air to be guided in a first direction for the air to be supplied to the storage compartment during a cooling operation, a defrosting heater configured to generate heat for defrost, a second flow path allowing air to be guided in a second direction opposite to the first direction for the air to be circulated around the evaporator during a defrosting operation, a fan allowing air having received heat from the defrosting heater to be circuited around the evaporator through the second flow path, and a flow path resistance portion provided on the second flow path to increase a flow path resistance in the first direction.

9 Claims, 15 Drawing Sheets

(56) References Cited

U.S. PATENT DOCUMENTS

| | | | | |
|---|---|---|---|---|
| 2017/0362073 | A1* | 12/2017 | Lee | F28D 7/087 |
| 2018/0259239 | A1* | 9/2018 | Kim | F25B 39/028 |

FOREIGN PATENT DOCUMENTS

| | | | | |
|---|---|---|---|---|
| KR | 10-2005-0006000 | A | | 1/2005 |
| KR | 10-2008-0074434 | A | | 8/2008 |
| KR | 20100085228 | A | * | 7/2010 |
| KR | 10-2015-0045796 | A | | 4/2015 |

OTHER PUBLICATIONS

Notice Requesting Submission of Opinion dated Aug. 19, 2022 in connection with Korean Patent Application No. 10-2018-0036769, 26 pages.

* cited by examiner

REFRIGERATOR

CROSS-REFERENCE TO RELATED APPLICATIONS

This application is a 371 National Stage of International Application No. PCT/KR2019/001970, filed Feb. 19, 2019, which claims priority to Korean Patent Application No. 10-2018-0036769, filed Mar. 29, 2018, the disclosures of which are herein incorporated by reference in their entirety.

BACKGROUND

1. Field

The disclosure relates to a refrigerator, and more specifically, to a refrigerator having a defrosting device capable of improving the defrosting efficiency.

2. Description of Related Art

In general, a refrigerator stores various types of food to be kept fresh for a long period of time by supplying a storage compartment with cold air that is generated by an evaporator. The storage compartment of the refrigerator is divided into a refrigerating compartment to keep food at about 3° C. above zero and a freezing compartment for keeping food frozen at about 20° C. below zero.

Specifically, the refrigerator includes an evaporator in which a low-pressure and low-temperature refrigerant evaporates while absorbing surrounding heat to exchange heat with indoor air in the storage compartment. In this case, water vapor introduced into the compartment from the outside at the room temperature or water vapor resulting from moisture contained in food stored in the compartment is frosted on the outer surface of the evaporator at a low temperature due to a temperature difference.

Since the frost formed on the surface of the evaporator lowers the heat exchange efficiency, lowers the cooling efficiency of the refrigerator, and increases the power consumption, a defrosting device for removing the frost is provided in the refrigerator.

The defrosting device may remove frost on the evaporator using a heater. In this case, the heater is located below the evaporator, causing a temperature difference between the upper end and the lower end of the evaporator, and thus a great amount of energy is inputted, thereby increasing the defrost energy and the power consumption of the refrigerator.

In addition, such a configuration increases the temperature in the storage compartment, and deteriorates food storage performance.

SUMMARY

Therefore, it is an object of the disclosure to provide a refrigerator including a defrosting device capable of improving defrosting efficiency.

It is another object of the disclosure to provide a refrigerator capable of improving power consumption by minimizing defrost energy by shortening a defrost time.

It is another object of the disclosure to provide a refrigerator capable of improving food storage performance by preventing the temperature of a storage compartment from increasing due to defrosting heat.

According to an aspect of the disclosure, there is provided a refrigerator including: a main body; a storage compartment provided inside the main body; an evaporator provided in the storage compartment and configured to generate cold air; a first flow path allowing air to be guided in a first direction for the air to be supplied to the storage compartment during a cooling operation; a defrosting heater configured to generate heat for defrost; a second flow path allowing air to be guided in a second direction opposite to the first direction for the air to be circulated around the evaporator during a defrosting operation; a fan allowing air having received heat from the defrosting heater to be circuited around the evaporator through the second flow path; and a flow path resistance portion provided on the second flow path to increase a flow path resistance in the first direction.

The first flow path may be configured to: allow air having transferred heat to the evaporator to be guided to the storage compartment during the cooling operation; and allow air having received heat from the defrosting heater to be guided to the second flow path.

The flow path resistance portion may be disposed at a lower portion of the second flow path.

The second flow path may allow air having passed through the first flow path to be guided in the second direction during the defrosting operation.

The flow path resistance portion may include a plurality of flow path resistance members that are asymmetrically arranged.

The plurality of flow path resistance members may be obliquely formed to reduce a flow resistance in a direction from an upper side to a lower side of the second flow path.

The plurality of flow path resistance members may be provided in different sizes.

The plurality of flow path resistance members may include at least one of a triangular shape, a streamlined shape, a wave shape, a polygonal shape, or a hemispherical shape.

The plurality of flow path resistance members may be formed in different sizes and shapes, and may be alternately arranged in a zigzag manner.

The refrigerator may further include a defrosting case that forms the second flow path, wherein the defrosting case may include: a first case; and a second case coupled to the first case to form the second flow path therein.

The plurality of flow path resistance members may be arranged on at least one of the first case or the second case.

The defrosting case may include a fan installation portion on which the fan is installed.

The defrosting case may include: an inlet allowing heat of the defrosting heater to be introduced into the second flow path after passing through the evaporator; and an outlet allowing air having passed through the second flow path to be discharged toward the evaporator.

The plurality of flow path resistance member may be integrally injection molded with the defrosting case.

According to another aspect of the disclosure, there is provided a refrigerator including: a main body; a storage compartment provided inside the main body; an evaporator provided in the storage compartment and configured to generate cold air; a first flow path allowing cold air to be guided to the storage compartment during a cooling operation; a first fan configured to move air in the first flow path to the storage compartment; and a defrosting device configured to remove frost, wherein the defrosting device may include: a defrosting heater configured to generate heat for defrost; a defrosting case forming a second flow path that allows air having received heat from the defrosting heater to be circulated around the evaporator; a second fan installed on the defrosting case and allowing air having passed through the first flow path to be guided to the second flow path during a defrosting operation; and a plurality of flow path resistance members provided in the second flow path.

The first fan and the second fan may rotate in opposite directions.

The flow path resistance member may be integrally injection molded with the defrosting case.

The first flow path may allow air having transferred heat to the evaporator to move from an upper side to a lower side during the cooling operation.

The flow path resistance member may be disposed at a lower portion of the second flow path to prevent air from moving to the second flow path during the cooling operation.

The plurality of flow path resistance members may be formed in different sizes and shapes, and may be alternately arranged in a zigzag manner.

Advantageous Effects

As is apparent from the above, the defrosting time is shortened so that defrost energy is minimized, thereby enhancing defrost efficiency and improving power consumption.

In addition, the temperature of a storage compartment is prevented from increasing due to defrosting heat, thereby improving food storage performance.

In addition, a damper is omitted unlike the existing technology, thereby improving the internal capacity of the storage compartment, reducing material cost, and improving the installation space and structural efficiency.

In addition, an asymmetric flow path shape with large flow resistance during general cooling operation and small flow resistance during defrosting operation is used, so that damage caused by a portion of air passing through an evaporator and then moving through a defrosting flow path can be minimized and the defrost time can be shortened.

DETAILED DESCRIPTION

Figure 1:
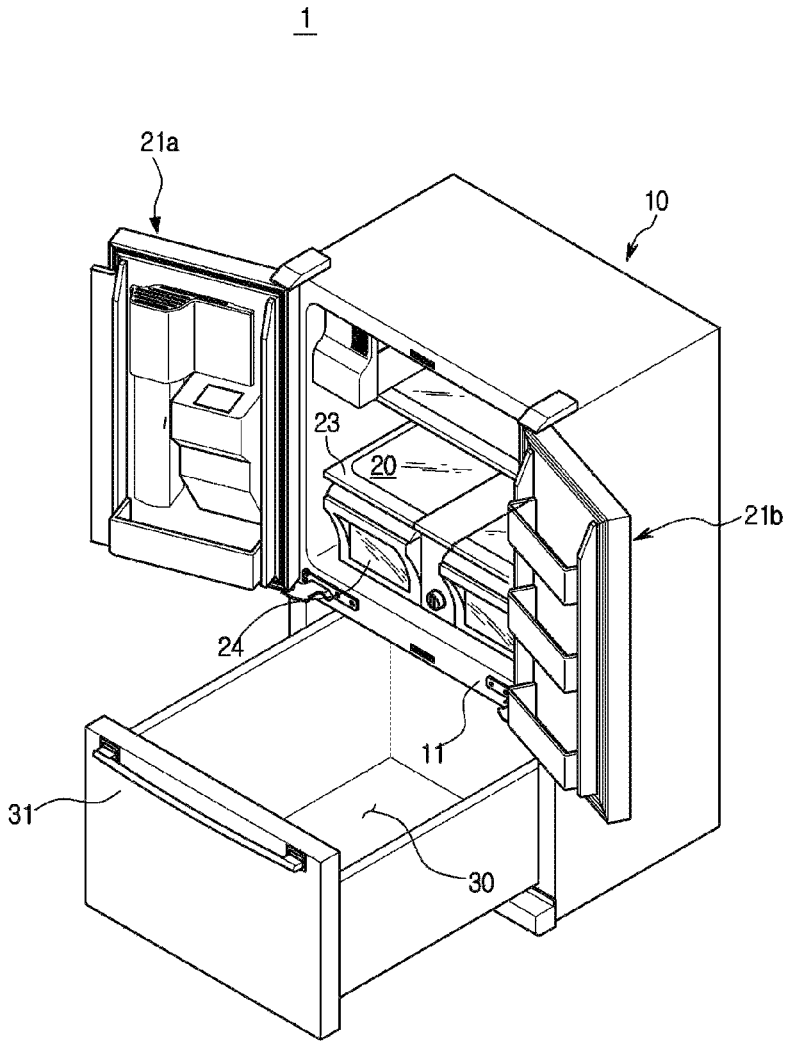
FIG. 1 is a view illustrating a refrigerator according to an embodiment of the disclosure.

The embodiments set forth herein and illustrated in the configuration of the present disclosure are only the most preferred embodiments and are not representative of the full the technical spirit of the present disclosure, so it should be understood that they may be replaced with various equivalents and modifications at the time of the disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

Hereinafter, embodiments according to the disclosure will be described in detail with reference to the accompanying drawings.

Figure 2:
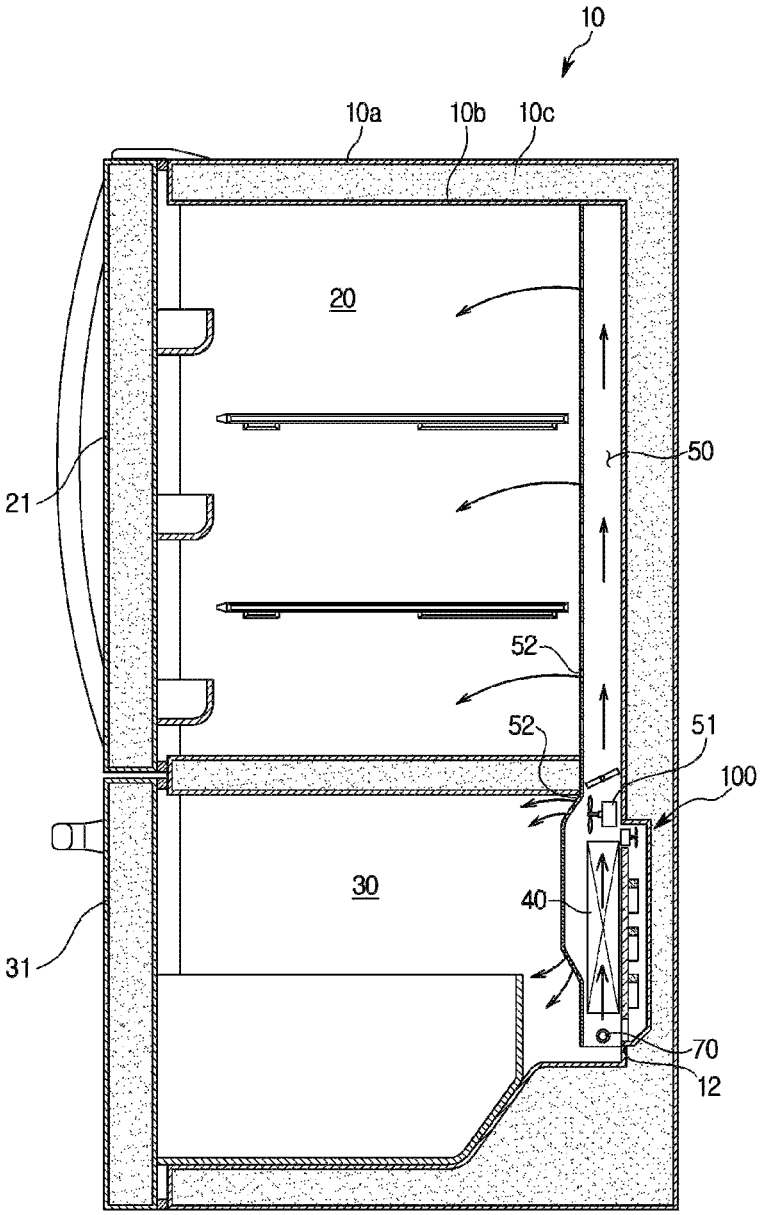
FIG. 2 is a cross-sectional view illustrating a refrigerator provided with a defrosting device according to an embodiment of the disclosure.
Figure 3:
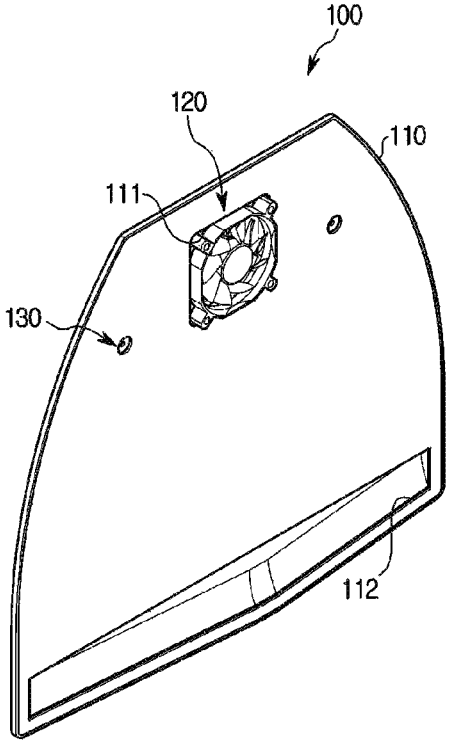
FIG. 3 is a perspective view illustrating a defrosting device according to an embodiment of the disclosure.
Figure 4:
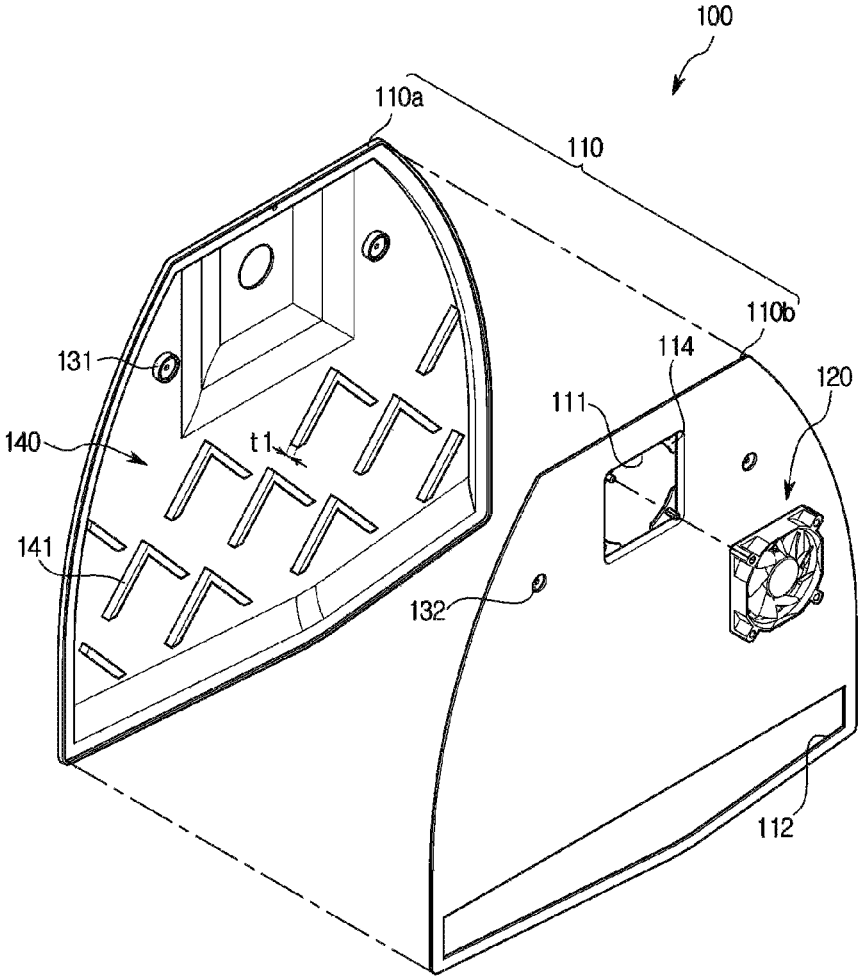
FIG. 4 is an exploded perspective view illustrating a defrosting device according to an embodiment of the disclosure.
Figure 5:
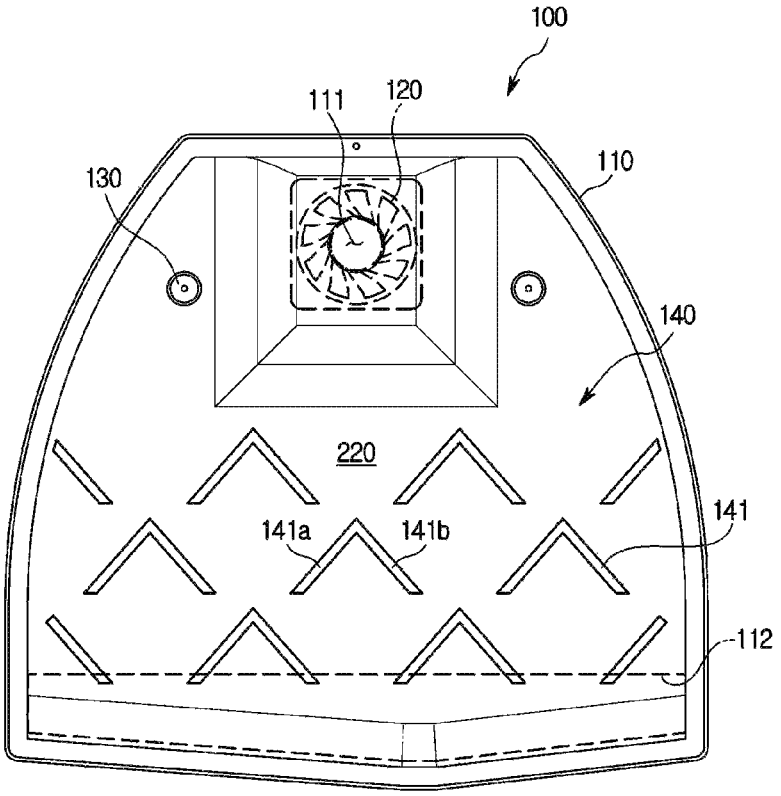
FIG. 5 is a front view illustrating a flow path resistance portion of a defrosting device according to an embodiment of the disclosure.
Figure 6:
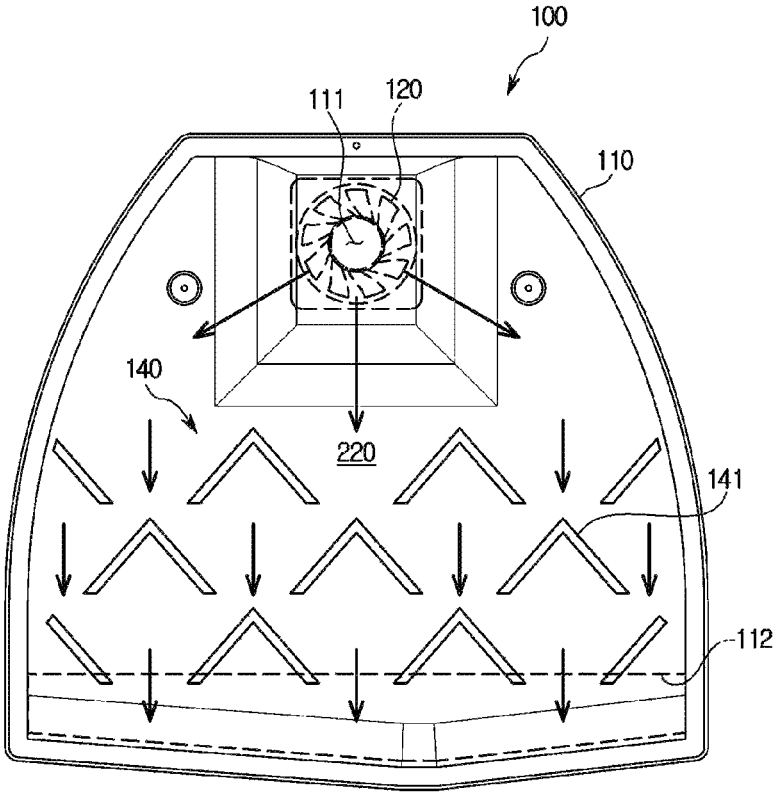
FIG. 6 is a view illustrating an operation of a flow path resistance portion according to an embodiment of the disclosure.
Figure 7:
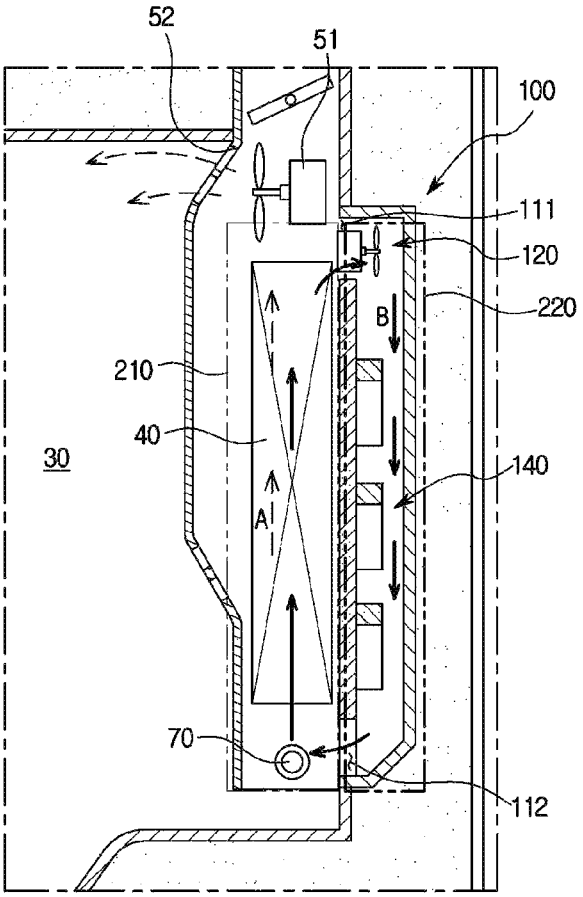
FIG. 7 is a schematic diagram illustrating a flow of air by a defrosting device according to an embodiment of the disclosure.

FIG. 1 is a view illustrating a refrigerator according to an embodiment of the disclosure, FIG. 2 is a cross-sectional view illustrating a refrigerator provided with a defrosting device according to an embodiment of the disclosure, FIG. 3 is a perspective view illustrating a defrosting device according to an embodiment of the disclosure, FIG. 4 is an exploded perspective view illustrating a defrosting device according to an embodiment of the disclosure, FIG. 5 is a front view illustrating a flow path resistance portion of a defrosting device according to an embodiment of the disclosure, FIG. 6 is a view illustrating an operation of a flow path resistance portion according to an embodiment of the disclosure, and FIG. 7 is a schematic diagram illustrating a flow of air by a defrosting device according to an embodiment of the disclosure.

Referring to FIGS. 1 to 7, a refrigerator 1 may include a main body 10, a storage compartment (a freezing compartment 20 and a refrigerating compartment 30) formed inside the main body 10, and an evaporator 40 supplying the storage compartments 20 and 30 with cold air.

The main body 10 includes an inner case 10*b* forming the storage compartments 20 and 30, an outer case 10*a* coupled to an outer side of the inner case 10*b* to form the external appearance of the refrigerator 1, and an insulating material 10*c* arranged between the inner case 10*b* and the outer case 10*a* to insulate the storage compartments 20 and 30.

The storage compartments 20 and 30 may be divided into the refrigerating compartment 20 at an upper side and the freezing compartment 30 at a lower side by an intermediate partition 11. The refrigerating compartment 20 is kept at a temperature of about 3° C. above zero to store food refrigerated, and the freezing compartment 30 is kept at a temperature of about 18.5° C. below zero to store food frozen. A shelf for placing food thereon and at least one storage box 24 for storing food may be provided in the refrigerator compartment 20.

The refrigerating compartment 20 and the freezing compartment 30 each have an open front to allow food to be put in and out, and the open front of the refrigerating compartment 20 is opened and closed by a pair of doors 21 (21*a* and 21*b*) hinged to the main body 10. The open front of the freezing compartment 30 may be opened and closed by a sliding door 31 that is slidable in a forward and backward direction with respect to the main body 10.

A machine room (not shown) accommodating a compressor (not shown) for compressing a refrigerant and a condenser (not shown) for condensing the compressed refrigerant is provided at a lower rear side of the main body 10.

An evaporator 40 for cooling the storage compartments 20 and 30 is installed at an inner rear side of the storage compartments 20 and 30, and a blower fan (hereinafter, referred to as a first fan 51) that circulates cold air into the storage compartments 20 and 30 is installed above the evaporator 40, and a cold air duct 50 is provided to guide the cold air induced by the first fan 51 to the storage compartments 20 and 30 to be discharged to the storage compartments 20 and 30.

A defrosting heater 70 for removing frost on the evaporator 40 is provided below the evaporator 40. The defrosting heater 70 removes ice or frost generated on the evaporator 40 and an outlet (not shown) provided in the cold air duct 50 so that cold air is smoothly discharged to the storage compartments 20 and 30.

The defrosting heater 70 may include at least one of a sheath heater, a cord heater, a high-temperature gas of a cycle itself, or a heat pump cycle.

The cold air duct 50 is provided behind the storage compartments 20 and 30 such that cold air generated by the evaporator 40, that is, air having transferred heat to the evaporator 40, is induced to be supplied to the storage compartments 20 and 30.

The evaporator 40 and the first fan 51 are mounted on the cold air duct 50. The cold air duct 50 may be formed with a cold air outlet 52 so that the cold air generated by the evaporator 40 is supplied to the storage compartments 20 and 30. The cold air outlet 52 may be formed in plural.

The cold air duct 50 includes a first flow path 210 such that the cold air generated by the evaporator 40 is supplied to the storage compartments 20 and 30 by the first fan 51 during a cooling operation.

The first flow path 210 is provided to allow air having transferred heat to the evaporator 40 to be guided to the storage compartments 20 and 30 during a cooling operation. The air having transferred heat to the evaporator 40 moves from a lower side of the first flow path 210 to an upper side of the first flow path 210 (hereinafter, referred to as a first direction A) by the first fan 51. The cold air having transferred heat to the evaporator 40 moves in the first direction A of the first flow path 210. In the embodiment of the disclosure, the evaporator 40 is illustrated as being provided behind the storage compartments 20 and 30 so that cold air is moved from the lower side to the upper side, but the concept of the disclosure is not limited thereto. For example, the evaporator may be disposed on a lower surface or an upper surface of the storage compartment to form a flow path in a direction corresponding to each of the lower surface and the upper surface.

The refrigerator 1 may include a defrosting device 100 provided to perform defrost. The defrosting device 100 includes a defrosting heater 70 generating heat for defrosting. The defrosting heater 70 may be provided below the evaporator 40. Air heated by the defrosting heater 70 is caused to rise and move by convection. In the embodiment of the disclosure, the cold air duct 50 and the first flow path 210 are illustrated as being provided in an upper and lower side direction so that air heated by the defrosting heater 70 moves from the lower side to the upper side (the first direction A), but the concept of the disclosure is not limited thereto. For example, the cold air duct and the evaporator may be arranged on the lower surface or the upper surface of the storage compartment. In addition, the defrosting heater is illustrated as being disposed below the ice maker, the concept of the disclosure is not limited thereto. For example, the ice making heater may be located on the top or side of the evaporator.

The defrosting device 100 may be disposed around the evaporator 40. The defrosting device 100 may be disposed behind the evaporator 40. The defrosting device 100 may be installed on the inner case 10*b* of the main body 10. The defrosting device 100 may be disposed between the inner case 10*b* and the outer case 10*a* of the main body 10. The defrosting device 100 may be fixed to the inner case 10*b* of the main body 10 by a fixing member, such as a bolt. The defrosting device 100 may be fixed by being pressed into the inner case 10*b*.

The defrosting device 100 may include a defrosting case 110 and a defrosting fan (hereinafter, referred to as a second fan 120) installed in the defrosting case 110.

The defrosting device 100 is provided such that, when air having received heat from the defrosting heater 70 is moved in the first direction A of the first flow path 210 by convection, the air having received heat from the defrosting heater moves to the second flow path 220 after passing through the first flow path 210.

The second flow path 220 is provided such that air having received heat from the defrosting heater 70 circulates around the evaporator 40 during the defrost operation. The second fan 120 may be installed so that air having received heat from the defrosting heater 70 is circulated to the second flow path 220. The second fan 120 is provided to allow air that has passed through the first flow path 210 to flow into the second flow path 220. In this case, the first fan 51 and the second fan 120 are driven to rotate in opposite directions. The defrosting case 110 includes a first case 110*a* and a second case 110*b*. The first case 110*a* and the second case 110*b* may be coupled through a case coupling portion 130. A first case coupling portion 131 is provided on the first case 110*a*, and a second case coupling portion 132 is provided on the second case 110*b*. The second case coupling portion 132 may be provided at a position corresponding to the first case coupling portion 131. The first case coupling portion 131 and the second case coupling portion 132 may be assembled to each other through a member, such as a bolt or a hook.

The second flow path 220 may be formed between the first case 110*a* and the second case 110*b*. The first case 110*a* may be coupled to the inner case 10*b* of the main body 10. In the embodiment of the disclosure, the defrosting case 110 is illustrated as being press-fitted and fixed to a defrosting device installation portion 12 formed on at least a part of the inner case 10*b* of the main body 10, but the concept of the disclosure is not limited thereto. For example, the defrosting case may be fixed to the inner case having at least a part thereof open through a fixing member, such as a bolt. In this case, at least one side of the defrosting case may be fixed by the insulating material 10*c*.

The defrosting case 110 includes an inlet 111 through which heat of the defrosting heater 70 passing through the evaporator 40 flows into the second flow path 220, and an outlet 112 through which air passing through the second flow path 220 is discharged toward the evaporator 40.

The inlet 111 and the outlet 112 may be each provided in the second case 110*b*. The inlet 111 may be disposed on an upper portion of the second case 110*b*, and the outlet 112 may be disposed at a lower portion of the second case 110*b*. In the embodiment of the disclosure, the inlet and the outlet are illustrated as being provided in the second case 110*b*, but the concept of the disclosure is not limited thereto.

The second fan 120 may be installed in at least one of the first case 110*a* or the second case 110*b*. The defrosting case 110 includes a fan installation portion 114 on which the second fan 120 is installed. The fan installation portion 114 may be formed around the inlet 111 of the defrosting case 110 to guide air introduced through the inlet 111 of the defrosting case 110 to the second flow path 220. The fan installation portion 114 may be disposed on an upper portion of the defrosting case 110. The fan installation portion 114 may be disposed at the center of the upper portion of the second case 110*b*. The fan installation portion 114 may be formed at a position corresponding to the inlet 111. The fan installation portion 114 may include the inlet 111.

Air having received heat from the defrosting heater 70 and passing through the first flow path 210 is introduced into the inlet 111 of the defrosting case 110 by the second fan 120 and guided to the second flow path 220, and the air introduced into the inlet 111 is guided in the second direction B of the second flow path 220 and discharged through the outlet 112.

The air discharged through the outlet 112 of the second flow path 220 moves toward the defrosting heater 70 again and receives heat from the defrosting heater 70, in which the air is heated and the heated air moves back to the evaporator 40 so that the defrosting heat is circulated without leakage.

On the other hand, the second flow path 220 includes a flow path resistance portion 140 provided to prevent air having received heat from the defrosting heater 70 from bypassing during a cooling operation.

The flow path resistance portion 140 may be formed on an inner lower side of the second flow path 220. The flow path resistance portion 140 is provided to form an asymmetric flow resistance inside the second flow path 220. The flow path resistance portion 140 may be provided so that a resistance in an upward direction is large and a resistance in a downward direction is small because the flow of air during the cooling operation is directed upward.

The flow path resistance portion 140 includes a plurality of flow path resistance members 141. The plurality of flow path resistance members 141 may be implemented in an asymmetric form on the surface of the second flow path 220. The flow path resistance member 141 may have a triangular shape and may be disposed in the second flow path 220. The flow path resistance member 141 may be formed to have a first thickness t1. The flow path resistance member 141 includes a first member 141*a* and a second member 141*b* connected to an upper end of the first member 141*a*. The second member 141*b* is bent from the upper end of the first member 141*a* to extend perpendicular to the first member 141*a*. The second member 141*b* and the first member 141*a* may be formed to have the same length.

The flow path resistance members 141 may be disposed in at least one line or more at the lower portion of the second flow path 220. The flow path resistance members 141 may be disposed in a zigzag manner to implement asymmetry on the lower portion of the second flow path 220. The flow path resistance member 141 is provided to reduce the downward flow resistance of the second flow path 220 and increase the upward flow resistance of the second flow path 220. The flow path resistance member 141 may be disposed in at least one of the first case 110*a* or the second case 110*b*. The flow path resistance member 141 may be injection-molded integrally with the defrosting case 110. The flow path resistance member 141 may be injection-molded integrally with the first case 110*a*. The flow path resistance member 141 may be injection-molded integrally with the second case.

FIG. 7 is a schematic diagram illustrating a flow of air by the defrosting device 100 of the refrigerator 1 during a cooling operation and a defrosting operation.

During the cooling operation of the refrigerator 1, the evaporator 40 generates cold air through heat exchange of a refrigerant, and the cold air generated by the evaporator 40 is moved in the first direction A by the first fan 51 provided above the evaporator 40, and supplied to each of the storage compartments 20 and 30 by being guided to the cold air duct 50.

In this case, the flow path resistance portion 140 of the defrosting device 100 is provided to increase the flow resistance in the upward direction such that air having transferred heat to the evaporator 40 does not flow to the second flow channel 220.

During the defrosting operation of the refrigerator 1, the defrosting heater 70 of the defrosting device 100 is operated. The hot air heated by the defrosting heater 70 rises by convection. The air having received heat from the defrosting heater 70 removes frost on the evaporator 40, passes through the first flow path 210, and then enters the second flow path 220 by the second fan 120.

In this case, the first fan 51 and the second fan 120 may be operated by rotating in opposite directions.

The air introduced into the second flow path 220 by the second fan 120, which has received heat from the defrosting heater 70, is moved in the second direction B and discharged through the outlet 112, and the air discharged through the outlet 112 is heated again by the defrosting heater 70 and moved to the evaporator 40 and circulated.

In this case, the flow path resistance portion 140 provided in the second flow path 220 is provided to reduce the flow resistance in the downward direction, thereby promoting the flow of air heated by receiving heat from the defrosting heater 70.

Conversely, the flow path resistance portion 140 provided in the second flow path 220 is provided to increase the flow resistance in the upper direction, thereby minimizing the loss of cold air bypassed by the second flow path 220 during a cooling operation.

Accordingly, the flow path resistance portion 140 of the defrosting device 100 increases the flow resistance of cold air toward the second flow path 220 during the cooling operation, and decreases the flow resistance of heated air toward the second flow path 220 during the defrosting operation, thereby minimizing a loss of cold air due to cold air flowing to the second flow path 220 during a cooling operation and shortening the defrost time through circulation of heated air so that the defrost energy may be improved.

Figure 8:
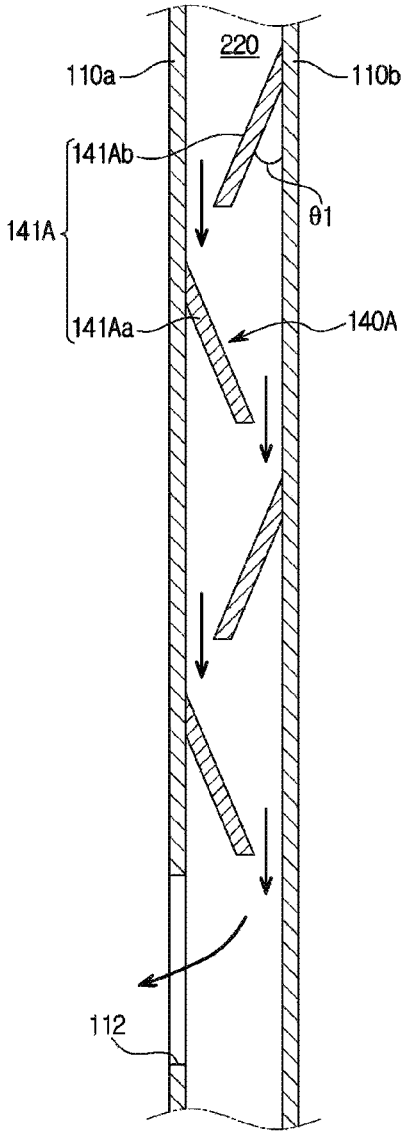
FIG. 8 is a view illustrating a defrosting device provided with a flow path resistance portion according to a second embodiment of the disclosure.

FIG. 8 is a view illustrating a defrosting device provided with a flow path resistance portion according to a second embodiment of the disclosure. Reference numerals not shown are referenced to FIGS. 1 to 7.

Referring to FIG. 8, a flow path resistance portion 140A of the defrosting device 100 includes a plurality of flow path resistance members 141A.

The flow path resistance member 141A may be implemented in an asymmetric form on the surface of the second flow path 220. The flow path resistance member 141A may be disposed on a lower portion of the defrosting case 110. The flow path resistance member 141A may be disposed in at least one of the first case 110*a* or the second case 110*b*. The flow path resistance member 141A may include a first resistance member 141Aa formed on the first case 110*a* and a second resistance member 141Ab formed on the second case 110*b*.

The first resistance member 141Aa and the second resistance member 141Ab may be alternately disposed. The first resistance member 141Aa and the second resistance member 141Ab may be formed to have an inclination of a first angle θ1 on the first case 110*a* and the second case 110*b*, respectively. The first resistance member 141Aa is formed to have an inclination of a first angle θ1 with respect to the first case 110*a* at the upper portion thereof. The second resistance member 141Ab is formed to have an inclination of a first angle θ1 with respect to the second case 110*b* at the upper portion thereof.

The flow path resistance members 141A may be disposed to implement asymmetry on the lower portion of the second flow path 220. The flow path resistance member 141A is provided to reduce the downward flow resistance of the second flow path 220 and increase the upward flow resistance of the second flow path 220. The flow path resistance member 141A may be injection-molded integrally with the defrosting case 110A. The first resistance member 141Aa of the flow path resistance member 141A may be injection-molded integrally with the first case 110*a*. The second resistance member 141Ab of the flow path resistance member 141A may be injection-molded integrally with the second case 110*b*.

The flow path resistance portion 140A provided on the second flow path 220 increases the flow resistance in the upper direction during a cooling operation, thereby minimizing a loss of cold air bypassed by the second flow path 220.

In addition, during the defrosting operation, the flow path resistance portion 140A is provided to reduce the flow resistance in the downward direction to guide the flow of air having received heat from the defrosting heater 70. That is, the flow path resistance portion 140A of the defrosting device 100 increases the flow resistance of the cold air during the cooling operation and decreases the flow resistance of the heated air during the defrosting operation, thereby minimizing the loss caused by cold air flowing to the second flow path 220 during a cooling operation while reducing the defrost time so that defrost energy is improved.

Meanwhile, since the flow of air by the flow path resistance portion 140A of the second flow path 220 according to the embodiment of the disclosure may be identical to that according to the first embodiment of the disclosure, a detailed description thereof will be omitted.

Figure 9:
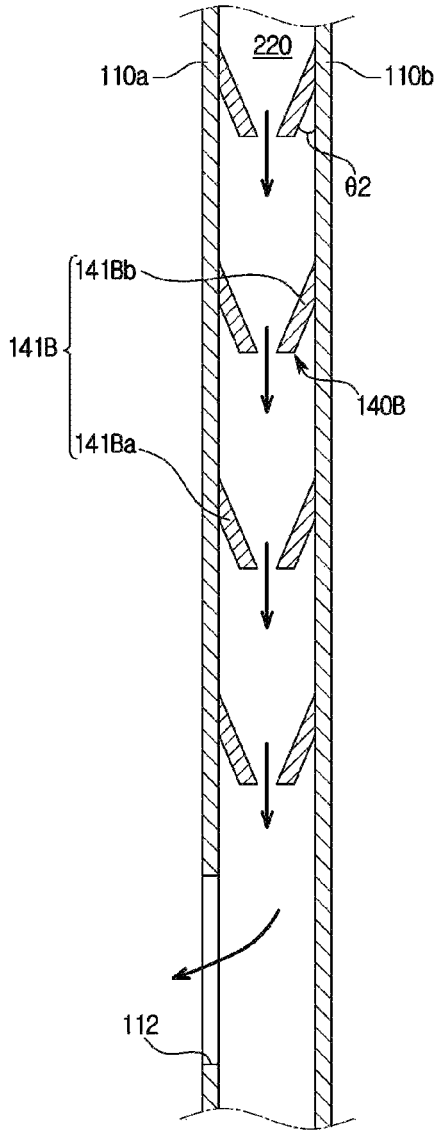
FIG. 9 is a view illustrating a defrosting device provided with a flow path resistance portion according to a third embodiment of the disclosure.

FIG. 9 is a view illustrating a defrosting device provided with a flow path resistance portion according to a third embodiment of the disclosure. Reference numerals not shown are referenced to FIGS. 1 to 7.

Referring to FIG. 9, a flow path resistance portion 140B of the defrosting device 100 includes a plurality of flow path resistance members 141B.

The flow path resistance member 141B may be implemented in an asymmetric form on the surface of the second flow path 220. The flow path resistance member 141B may be disposed on a lower portion of the defrosting case 110. The flow path resistance member 141B may be disposed in at least one of the first case 110*a* or the second case 110*b*. The flow path resistance member 141B may include a first resistance member 141Ba formed on the first case 110*a* and a second resistance member 141Bb formed on the second case 110*b*.

The first resistance member 141Ba and the second resistance member 141Bb may be disposed to be opposite to each other. The first resistance member 141Ba and the second resistance member 141Bb may be formed to have an inclination of a second angle θ2 on the first case 110*a* and the second case 110*b*, respectively. The first resistance member 141Ba is formed to have an inclination of a second angle θ2 with respect to the first case 110*a* at the upper portion thereof. The second resistance member 141Bb is formed to have an inclination of a second angle θ2 with respect to the second case 110*b* at the upper portion thereof.

The flow path resistance member 141B may be disposed to implement asymmetry on the lower portion of the second flow path 220. The flow path resistance member 141B is provided to reduce the downward flow resistance of the second flow path 220 and increase the upward flow resistance of the second flow path 220. The flow path resistance member 141B may be injection-molded integrally with the defrosting case 110B.

The flow path resistance portion 140B of the defrosting device 100 increases the flow resistance of cold air toward the second flow path 220 during the cooling operation, and decreases the flow resistance of heated air during the defrosting operation, thereby minimizing a loss of cold air due to cold air flowing to the second flow path 220 and shortening the defrost time through circulation of heated air so that the defrost energy may be improved.

Meanwhile, since the flow of air by the flow path resistance portion 140B of the second flow path 220 according to the embodiment of the disclosure may be identical to that according to the first embodiment of the disclosure, a detailed description thereof will be omitted.

Figure 10:
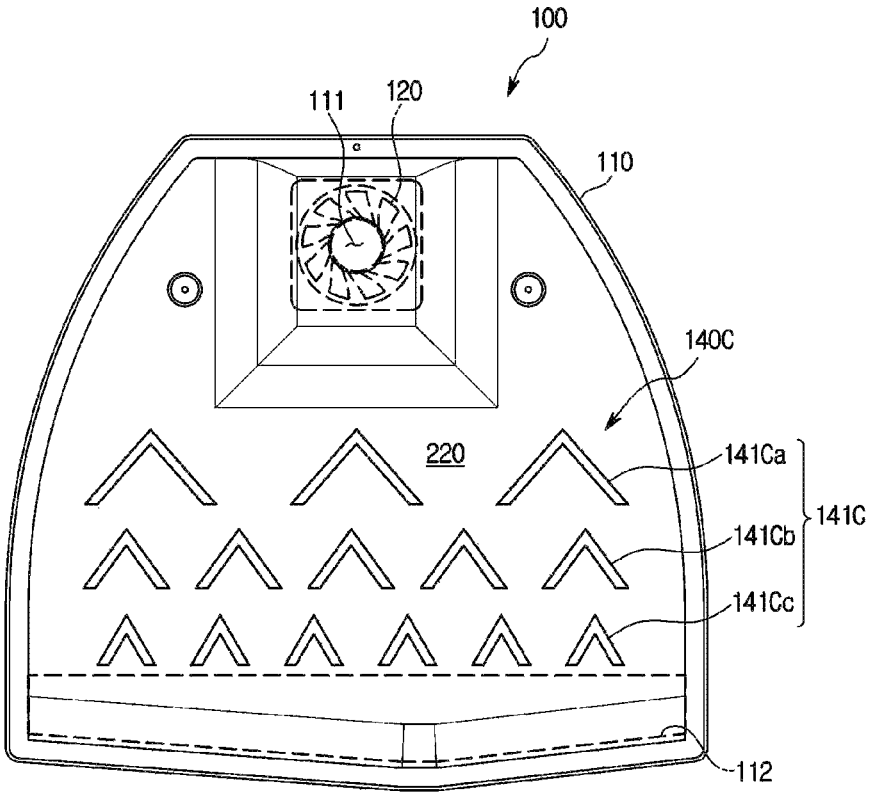
FIG. 10 is a view illustrating a defrosting device provided with a flow path resistance portion according to a fourth embodiment of the disclosure.

FIG. 10 is a view illustrating a defrosting device provided with a flow path resistance portion according to a fourth embodiment of the disclosure. Reference numerals not shown are referenced to FIGS. 1 to 7.

A flow path resistance portion 140C of the defrosting device 100 includes a plurality of flow path resistance members 141C.

The flow path resistance member 141C may be implemented in an asymmetric form on the surface of the second flow path 220. The flow path resistance member 141C may have a triangular shape and may be provided in the second flow path 220. The flow path resistance members 141C may be disposed in at least one line or more at the lower portion of the second flow path 220. The flow path resistance member 141C may be disposed in a zigzag manner to implement an asymmetry on the lower portion of the second flow path 220.

The flow path resistance member 141 includes a first member 141Ca disposed on the upper side, a second member 141Cb disposed below the first member 141Ca, and a third member 141Cc disposed below the second member 141Cb.

The first member 141Ca, the second member 141Cb, and the third member 141Cc may have different sizes. The first member 141Ca is formed larger than the second and third members 141Cb and 141Cc. The second member 141Cb is formed larger than the third member 141Cc. Asymmetric flow resistance may be implemented by variously changing the arrangement of the flow path resistance members 141C provided in the same shape and different sizes.

The flow path resistance member 141C is provided to reduce the downward flow resistance of the second flow path 220 and increase the upward flow resistance of the second flow path 220. The flow path resistance member 141C may be injection-molded integrally with the defrosting case 110.

The flow path resistance portion 140C increases the flow resistance of cold air toward the second flow path 220 during the cooling operation, and decreases the flow resistance of heated air during the defrosting operation, thereby minimizing a loss of cold air due to cold air flowing to the second flow path 220 and shortening the defrost time through circulation of heated air so that the defrost energy may be improved.

Meanwhile, since the flow of air by the flow path resistance portion 140C of the second flow path 220 according to the embodiment of the disclosure may be identical to that according to the first embodiment of the disclosure, a detailed description thereof will be omitted.

Figure 11:
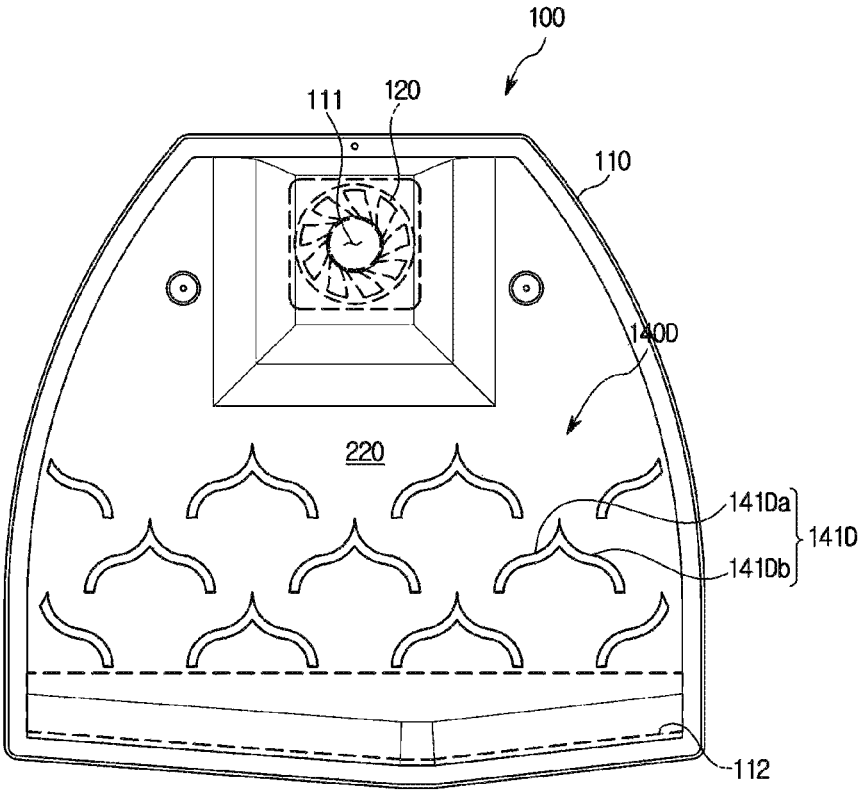
FIG. 11 is a view illustrating a defrosting device provided with a flow path resistance portion according to a fifth embodiment of the disclosure.

FIG. 11 is a view illustrating a defrosting device provided with a flow path resistance portion according to a fifth embodiment of the disclosure. Reference numerals not shown are referenced to FIGS. 1 to 7.

A flow path resistance portion 140D of the defrosting device 100 includes a plurality of flow path resistance members 141D.

The flow path resistance member 141D may be implemented in an asymmetric form on the surface of the second flow path 220. The flow path resistance member 141D may be provided in a streamlined shape in the second flow path 220. The flow path resistance members 141D may be disposed on the lower portion of the second flow path 220 in at least one line or more. The flow path resistance member 141D may be disposed in a zigzag manner to implement an asymmetry on the lower portion of the second flow path 220. The flow path resistance member 141D may include a first resistance member 141Da formed in a curved shape and a second resistance member 141Db formed in a curved shape and connected to the first resistance member 141Da. The first resistance member 141Da and the second resistance member 141Db may be formed to be symmetrical to each other. The flow path resistance member 141D is provided to reduce the downward flow resistance of the second flow path 220 and increase the upward flow resistance of the second flow path 220. The flow path resistance member 141D may be injection-molded integrally with the defrosting case 110.

The flow path resistance portion 140D of the defrosting device 100 increases the flow resistance of cold air toward the second flow path 220 during the cooling operation, and decreases the flow resistance of heated air during the defrosting operation, thereby minimizing a loss of cold air due to cold air flowing to the second flow path 220 and shortening the defrost time through circulation of heated air so that the defrost energy may be improved.

Meanwhile, since the flow of air by the flow path resistance portion 140D of the second flow path 220 according to the embodiment of the disclosure may be identical to that according to the first embodiment of the disclosure, a detailed description thereof will be omitted.

Figure 12:
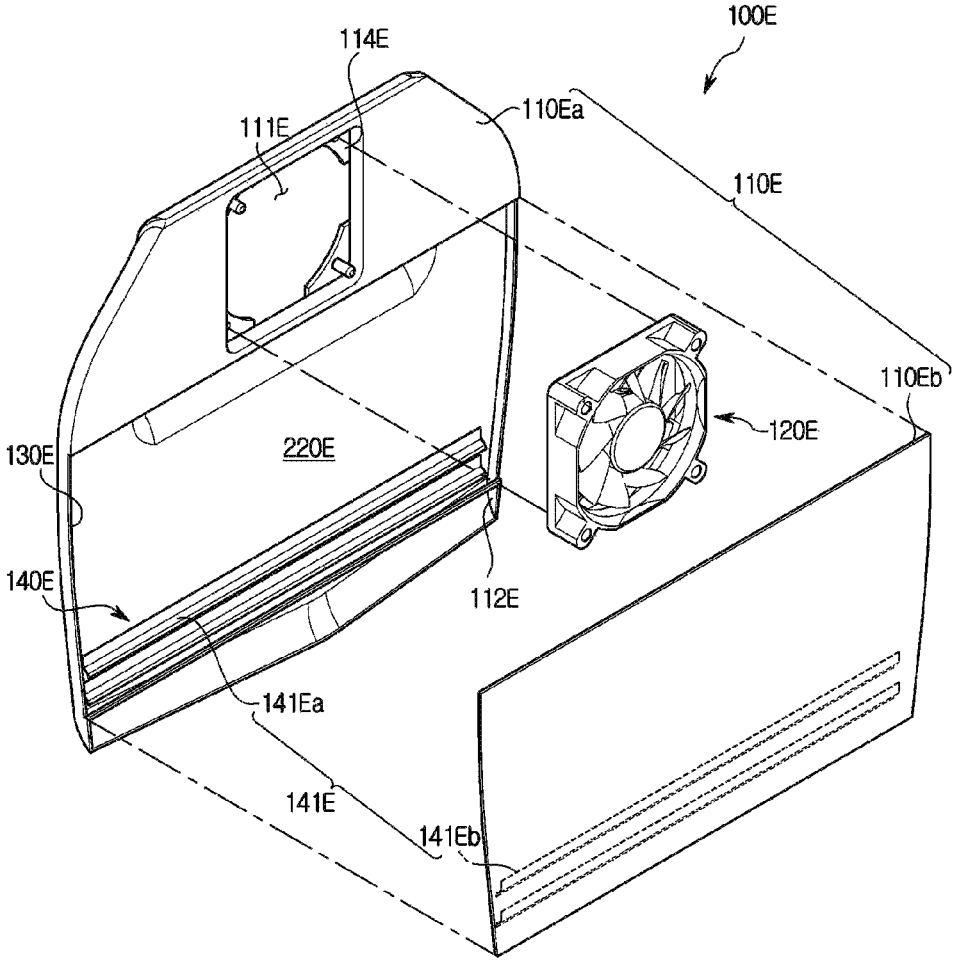
FIG. 12 is a partially exploded perspective view illustrating a defrosting device provided with a flow path resistance portion according to a sixth embodiment of the disclosure.
Figure 13:
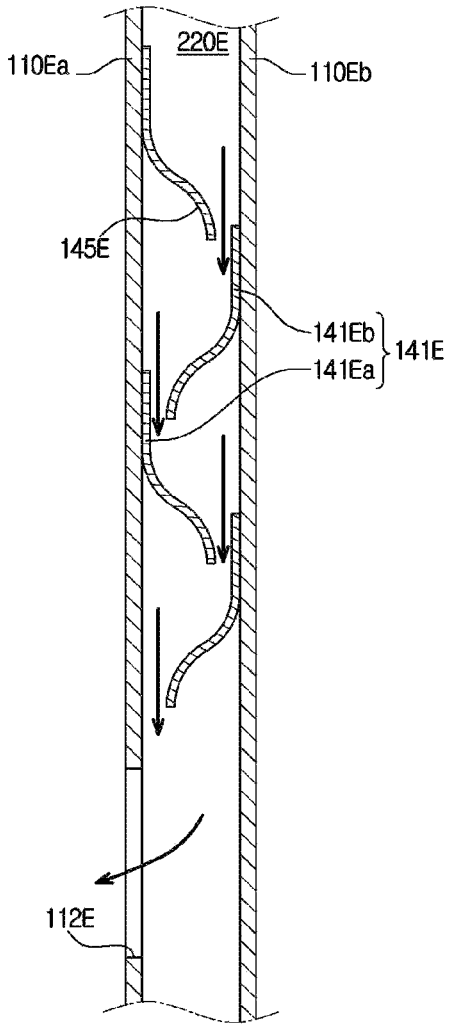
FIG. 13 is a view illustrating a cross-section of a defrosting device provided with a flow path resistance portion according to a sixth embodiment of the disclosure.

FIG. 12 is a partially exploded perspective view illustrating a defrosting device provided with a flow path resistance portion according to a sixth embodiment of the disclosure, and FIG. 13 is a view illustrating a cross-section of a defrosting device provided with a flow path resistance portion according to a sixth embodiment of the disclosure. Reference numerals not shown are referenced to FIGS. 1 to 7.

Referring to FIGS. 12 to 13, a defrosting device 100E includes a defrosting case 110E. The defrosting case 110E includes a first case 110Ea and a second case 110Eb.

The first case 110Ea and the second case 110Eb may be coupled to each other through a case coupling portion 130E. The case coupling portion 131E is provided on the first case 110Ea. The second case 110Eb is formed in a plate shape. The second case 110Eb is coupled to the case coupling portion 131E of the first case 110Ea.

A second flow path 220E is formed between the first case 110Ea and the second case 110Eb. The first case 110Ea includes an inlet 111E allowing heat of the defrosting heater 70 to flows into the second flow path 220E after passing through the evaporator 40 and an outlet 112 allowing air passing through the second flow path 220E to be discharged toward the evaporator 40.

The inlet 111E and the outlet 112E may be each provided in the first case 110Ea. The inlet 111E may be disposed on an upper portion of the first case 110Ea, and the outlet 112E may be disposed on a lower portion of the first case 110Ea.

The first case 110Ea includes a fan installation portion 114E on which a second fan 120E is installed. The fan installation portion 114E may be formed to guide air introduced through the inlet 111E to the second flow path 220E.

Air having received heat from the defrosting heater 70 and passing through the first flow path 210 is introduced into the inlet 111E of the defrosting case 110E by the second fan 120E, and guided to the second flow path 220E, and the air introduced into the inlet 111E is guided in the second direction B of the second flow path 220E and discharged through the outlet 112E.

The air discharged through the outlet 112E of the second flow path 220E moves toward the defrosting heater 70 again and receives heat from the defrosting heater 70, in which the air is heated, and the heated air moves back to the evaporator 40 so that the defrosting heat is circulated without leakage.

Meanwhile, the second flow path 220E includes a flow path resistance portion 140E that generates flow resistance to prevent air having received heat from the defrosting heater 70 from being bypassed and moved toward the storage compartments 20 and 30 during a cooling operation.

The flow path resistance portion 140E may be formed in an asymmetric form. The flow path resistance portion 140E is provided to form an asymmetric flow resistance. The flow path resistance portion 140E may be provided so that a resistance in an upward direction is large and a resistance in a downward direction is small because the flow of air during the cooling operation is directed upward.

The flow path resistance portion 140E includes a plurality of flow path resistance members 141E. The flow path resistance member 141E may be implemented in an asymmetric form on the surface of the second flow path 220E. The flow path resistance member 141E may be provided in a curved shape in the second flow path 220E. The flow path resistance member 141E may be arranged lengthwise along the traverse direction of the second flow path 220E. The flow path resistance members 141E have a streamline shape, and have a respective upper end fixed to a corresponding one of the first case 110Ea and the second case 110Eb. The lower end of the flow path resistance member 141E is provided to be spaced apart from a corresponding one of the first case 110Ea and the second case 110Eb.

The flow path resistance members 141E may be disposed in at least one line or more on the lower portion of the second flow path 220E. The flow path resistance member 141E is provided to reduce the downward flow resistance of the second flow path 220 and increase the upward flow resistance of the second flow path 220. The flow path resistance member 141E may be disposed in at least one of the first case 110Ea and the second case 110Eb. The flow path resistance member 141E may include a first member 141Ea provided on the first case 110Ea and a second member 141Eb provided on the second case 110Eb. The first member 141Ea and the second member 141Eb may be spaced apart from each other and may be alternately disposed. The flow path resistance member 141E may be injection-molded integrally with the defrosting case 110E.

The flow path resistance portion 140E of the defrosting device 100 increases the flow resistance of cold air toward the second flow path 220 during the cooling operation, and decreases the flow resistance of heated air during the defrosting operation, thereby minimizing a loss of cold air due to cold air flowing to the second flow path 220 and shortening the defrost time through circulation of heated air so that the defrost energy may be improved.

Meanwhile, since the flow of air by the flow path resistance portion 140E of the second flow path 220E according to the embodiment of the disclosure may be identical to that according to the first embodiment of the disclosure, a detailed description thereof will be omitted.

Figure 14:
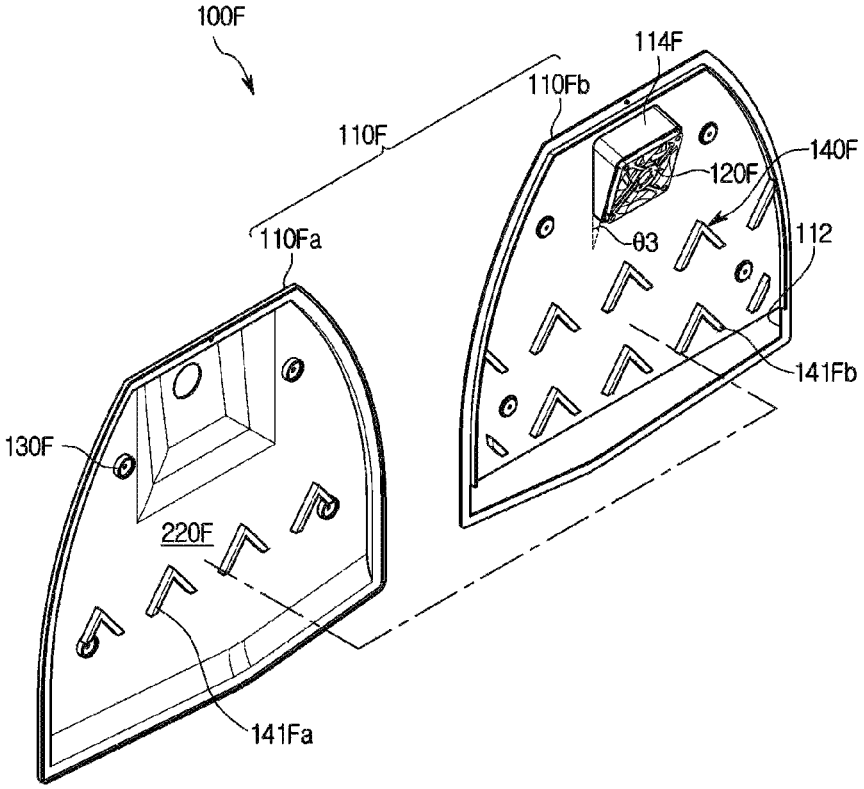
FIG. 14 is a partially exploded perspective view illustrating a defrosting device according to a seventh embodiment of the disclosure.
Figure 15:
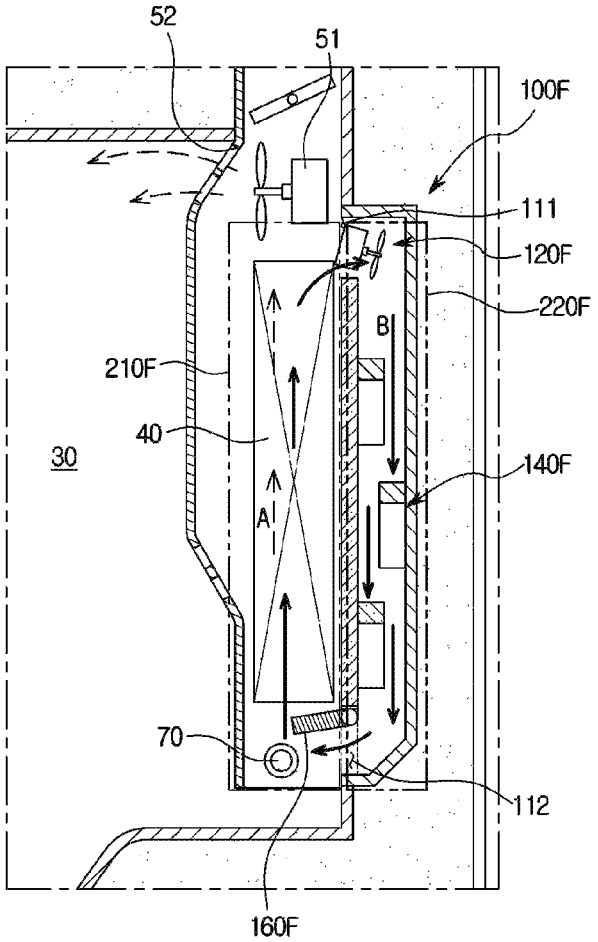
FIG. 15 is a schematic diagram illustrating a flow of air by a defrosting device according to a seventh embodiment of the disclosure.

FIG. 14 is a partially exploded perspective view illustrating a defrosting device according to a seventh embodiment of the disclosure, and FIG. 15 is a schematic diagram illustrating a flow of air by a defrosting device according to a seventh embodiment of the disclosure. Reference numerals not shown are referred to FIGS. 1 to 7.

Referring to FIGS. 14 to 15, a defrosting device 100F includes a first case 110Fa and a second case 110Fb.

The first case 110Fa and the second case 110Fb may be coupled to each other through a case coupling portion 130E.

A second flow path 220F is formed between the first case 110Fa and the second case 110Fb. The second case 110Fb includes an inlet 111F allowing heat of the defrosting heater 70 to flows into the second flow path 220F after passing through the evaporator 40, and an outlet 112 allowing air passing through the second flow path 220F to be discharged toward the evaporator 40.

The second case 110Fb includes a fan installation portion 114F on which a second fan 120F is installed. The fan installation portion 114F may be formed to guide the air introduced through the inlet 111F to the second flow path 220F.

In this case, the fan installation portion 114F may be provided so that the second fan 120F is installed at a third angle θ3. The second fan 120F may be installed at a third angle θ3. Through the second fan 120F, air having received heat from the defrosting heater 70 passes through the first flow path 210 and enters the inlet 111F of the defrosting case 110F to be guided to the second flow path 220F, and then guided in the second direction B of the second flow path 220F and discharged through the outlet 112F.

In addition, the air discharged through the outlet 112F of the second flow path 220F moves to the defrosting heater 70 again and receives heat from the defrosting heater 70, in which the air is heated and the heated air moves back to the evaporator 40 so that defrosting heat is circulated without leakage.

The second fan 120F is installed to have a predetermined angle in the second flow path 120F, so that the defrosting flow of the second flow path 120F is increased.

Meanwhile, the second flow path 220F may further include an opening and closing member 160F that is openable and closable so as to be closed by gravity and opened only in one direction by an operation of the second fan 120F to prevent air having received heat from the defrosting heater 70 from moving toward the storage compartments 20 and 30 during a cooling operation. The opening and closing member 160F may be installed at the outlet 112F of the second flow path 220F. The opening and closing member 160F is provided to prevent air having transferred heat to the evaporator 40 from moving toward the second flow path 220F during the cooling operation. The opening and closing member 160F may include at least one of a damper or a valve.

The flow path resistance portion 140F of the defrosting device 100 increases the flow resistance of cold air toward the second flow path 220 during the cooling operation, and decreases the flow resistance of heated air during the defrosting operation, thereby minimizing a loss of cold air due to cold air flowing to the second flow path 220 and shortening the defrost time through circulation of heated air so that the defrost energy may be improved.

Meanwhile, since the flow of air by the flow path resistance portion 140F of the second flow path 220 according to the embodiment of the disclosure may be identical to that according to the first embodiment of the disclosure, a detailed description thereof will be omitted.

Although few embodiments of the disclosure have been shown and described, the above embodiment is illustrative purpose only, and it would be appreciated by those skilled in the art that changes and modifications may be made in these embodiments without departing from the principles and scope of the disclosure, the scope of which is defined in the claims and their equivalents.

The invention claimed is:

1. A refrigerator comprising:

a main body;

a storage compartment provided inside the main body;

an evaporator provided in the storage compartment and configured to generate cold air;

a first flow path configured to allow air to be guided in an upward direction through the evaporator for the air to be supplied to the storage compartment during a cooling operation;

a defrosting heater configured to generate heat for defrosting the evaporator during a defrosting operation;

a second flow path configured to allow air to be guided in a downward direction for the air to be circulated around the evaporator and the defrosting heater during the defrosting operation;

a defrosting case forming the second flow path;

a fan configured to allow air having received heat from the defrosting heater to be circuited around the evaporator through the second flow path; and a flow path resistance portion provided on the second flow path and formed in a shape such that a flow path resistance in the upward direction in the second flow path is greater than a flow path resistance in the downward direction in the second flow path, wherein the defrosting case includes:

a first case forming a front portion of the second flow path, and a second case coupled to the first case to form a rear portion of the second flow path, and wherein the flow path resistance portion includes:

a first resistance member extending obliquely downward from the first case, and a second resistance member extending obliquely downward from the second case.

2. The refrigerator of claim 1, wherein the first flow path is configured to:

allow air having transferred heat to the evaporator to be guided to the storage compartment during the cooling operation; and allow air having received heat from the defrosting heater to be guided to the second flow path.

3. The refrigerator of claim 1, wherein the flow path resistance portion is disposed at a lower portion of the second flow path.

4. The refrigerator of claim 3, wherein the second flow path allows air having passed through the first flow path to be guided in the downward direction during the defrosting operation.

5. The refrigerator of claim 1, wherein the first and second resistance members are spaced apart from each other.

6. The refrigerator of claim 5, wherein the first and second resistance members are alternately arranged in a zigzag manner.

7. The refrigerator of claim 1, wherein the defrosting case includes a fan installation portion on which the fan is installed.

8. The refrigerator of claim 1, wherein the defrosting case includes:

an inlet configured to allow heat of the defrosting heater to be introduced into the second flow path after passing through the evaporator; and an outlet configured to allow air having passed through the second flow path to be discharged toward the evaporator.

9. The refrigerator of claim 1, wherein the first and second resistance members are integrally injection molded with the defrosting case.

* * * * *